US007041336B2

(12) United States Patent
Masuda et al.

(10) Patent No.: US 7,041,336 B2
(45) Date of Patent: May 9, 2006

(54) INTERMITTENT COATING APPARATUS AND INTERMITTENT COATING METHOD

(75) Inventors: Noboru Masuda, Ikoma (JP); Masaru Watanabe, Nishinomiya (JP)

(73) Assignee: Matsushita Electric Industrial, Co., Ltd., Osaka (JP)

( * ) Notice: Subject to any disclaimer, the term of this patent is extended or adjusted under 35 U.S.C. 154(b) by 0 days.

(21) Appl. No.: 10/617,865

(22) Filed: Jul. 14, 2003

(65) Prior Publication Data

US 2004/0062866 A1 Apr. 1, 2004

Related U.S. Application Data

(62) Division of application No. 09/498,749, filed on Feb. 7, 2000.

(30) Foreign Application Priority Data

Feb. 10, 1999 (JP) ..... 11-032637
Nov. 2, 1999 (JP) ..... 11-313076

(51) Int. Cl.
*B05D 1/26* (2006.01)

(52) U.S. Cl. ..... 427/256; 427/286; 427/420

(58) Field of Classification Search ..... 427/420, 427/256, 284, 286; 118/410, 419
See application file for complete search history.

(56) References Cited

U.S. PATENT DOCUMENTS 3,895,748 A 7/1975 Klingenburg
4,744,330 A 5/1988 Claassen
5,360,629 A * 11/1994 Milbourn et al. ..... 427/8
5,536,313 A * 7/1996 Watanabe et al. ..... 118/303
5,824,156 A 10/1998 Watanabe et al.
5,882,408 A 3/1999 Fujita
5,989,622 A * 11/1999 Iwashita et al. ..... 427/58
6,284,405 B1 * 9/2001 Kaido et al. ..... 429/94

OTHER PUBLICATIONS

Japanese Application No. 7-31197 (JP Laid-Open H8-229481) with Abstract corresponding to 7-31197, cited in the specification.

* cited by examiner

*Primary Examiner*—Fred J. Parker
(74) *Attorney, Agent, or Firm*—Smith, Gambrell & Russell, LLP

(57) ABSTRACT

The intermittent coating apparatus which includes a nozzle 1 which applies a paint 6 to a base material, a feeding side two-way valve 10 which repeats feeding of the paint 6 to the nozzle 1 and stop of the feeding, a return side two-way valve which 11 repeats discharge of the paint 6 to a return side and stop of the discharge, a paint flow path 12, means to feed the paint 6 into the flow path 12, and paint returning means 5 which repeats suction and return of the paint 6 out of and into the nozzle 1, and is characterized in that switching of the feeding side two-way valve 10 is carried out earlier than that of the return side two-way valve 11 within a range not shorter than 5 msec and not longer than 100 msec at least at a coating start time.

2 Claims, 9 Drawing Sheets

INTERMITTENT COATING APPARATUS AND INTERMITTENT COATING METHOD

CROSS REFERENCE TO RELATED APPLICATION

This application is a division of Ser. No. 09/498,749, filed Feb. 7, 2000 and which is being incorporated in its entirety herein by reference.

BACKGROUND OF THE INVENTION

1. Field of the Invention

The present invention relates to an intermittent coating apparatus and an intermittent coating method for intermittently coating a paint to a base material which is running continuously to form intermittent layers thereon.

2. Related Art of the Invention

Japanese Patent Laid-Open No. 7-311997 discloses a coating apparatus for intermittently coating a paint to a base material which is running continuously. This apparatus adopts such a method that winds a base material in a field of batteries around a back roll and disposes a nozzle at a location opposed to the base material, and repeats feeding of the paint to the nozzle and stop of the feeding, thereby forming portions not coated with the paint, that is, lead welding portions on the base material.

However, when a paste for batteries is intermittently coated as a paint to a collector material by the coating apparatus disclosed by Japanese Patent Application Laid-Open No. 7-311997, an active substance layer is coated approximately 30 to 100 mm thick in a section of approximately 20 mm from the coating start terminal of the active substance layer in a running direction of the collector material as shown in FIG. 7, whereby the active substance layer of a thickly coated portion may be peeled off and drop down at a subsequent rolling step. It is considered that this defect is caused by the fact that because a feeding path and a return path are momentarily set to simultaneously opened status at the time of switching the feeding path and the return path at the intermittent time by moving a head used as intermittent means, thereby the paint excessively flows from the return side into the feeding side, or the nozzle. Accordingly, the layer is coated thicker for an amount of the paint which excessively flows into the nozzle at a coating start time.

SUMMARY OF THE INVENTION

The present invention has an object to provide an intermittent coating apparatus and a coating method which are capable of intermittently coating a paint to a base material so as to form a layer which has a uniform thickness in a longitudinal direction and to prevent the layer from being thickened at a coating start terminal.

An intermittent coating apparatus of the present invention comprises:

a nozzle which applies a paint to a base material; and intermittent means which repeats feeding and stopping of said paint to said nozzle as well as discharge and stopping of said paint to a return side, wherein said intermittent means stops the discharge of the paint to said return side after staring the feeding of the paint to said nozzle, at least at the time of starting the coating.

An intermittent coating apparatus of the present invention comprises:

a nozzle which applies a paint to a base material; and intermittent means which repeats feeding and stopping of said paint to said nozzle as well as discharge and stopping of said paint to a return side, wherein said intermittent means starts the discharge of the paint to said return side after stopping the feeding of the paint to said nozzle, at least at the time of ending the coating.

An intermittent coating apparatus of the present invention comprises:

intermittent means which intermittently feeds a paint to a nozzle; and paint returning means which repeats suction and return of said paint out of and into said nozzle, wherein the relation between an operation time A to suck said paint out of said nozzle and an operation time B to return said paint into said nozzle is in a relation of $A<B$.

An intermittent coating apparatus of the present invention comprises:

intermittent means which intermittently feeds a paint to a nozzle; and paint returning means which repeats suction and return of said paint out of and into said nozzle by making a bellow-phragm disposed in said nozzle move up and down.

An intermittent coating apparatus of the present invention comprises:

a nozzle which applies a paint to a base material; and intermittent means which repeats feeding and stopping of said paint to said nozzle as well as discharge and stopping of said paint to a return side, wherein said intermittent means comprises a feeding side two-way valve which repeats the feeding of said paint to said nozzle and stop of the feeding, a return side two-way valve which repeats the discharge of said paint to the return side, a flow path through which said paint flows, and control means which can independently control the operations of said feeding side two-way valve and said return side two-way valve.

An intermittent coating apparatus of the present invention comprises:

a nozzle which applies a paint to a base material, intermittent means which repeats feeding and stopping of said paint to said nozzle as well as discharge and stopping of said paint to a return side, and a mixer which is disposed in a flow path between said nozzle and said intermittent means.

An intermittent coating method of the present invention for intermittent coating by utilizing an intermittent coating apparatus comprising a nozzle which applies a paint to a base material and intermittent means which repeats feeding and stopping of said paint to said nozzle as well as discharge and stopping of said paint to a return side, is such method that said intermittent means stops the discharge of the paint to said return side after starting the feeding of the nozzle to said nozzle, at least a coating start time.

An intermittent coating method of the present invention for intermittent coating by utilizing an intermittent coating apparatus comprising a nozzle which applies a paint to a base material and intermittent means which repeats feeding and stopping of said paint to said nozzle as well as discharge and stopping of said paint to a return side, is such method that said intermittent means starts the discharge of the paint to said return side after stopping feeding of the paint to said nozzle, at least at a coating end time.

An intermittent coating method of the present invention for intermittent coating by utilizing an intermittent coating apparatus comprising intermittent means which intermittently feeds a paint to a nozzle and paint returning means which repeats suction and return of said paint out of and into said nozzle, is such that an operation time A to suck said paint out of said nozzle and an operation time B to return said paint into said nozzle are in a relation of A<B.

An intermittent coating method of the present invention for intermittent coating by utilizing intermittent means which intermittently feeds a paint to a nozzle, is such method that said method allows said paint to be sucked and returns out of and into said nozzle by moving up and down a bellowphragm disposed in said nozzle.

An intermittent coating method of the present invention for intermittent coating by utilizing an intermittent coating apparatus comprising a nozzle which applies a paint to a base material and intermittent means which repeats feeding and stopping of said paint to said nozzle as well as discharge and stopping of said paint to a return side, is such method that a feeding side two-way valve for repeating feeding of said paint to said nozzle and stop of the feeding and a return side two-way valve for repeating discharge of said paint to the return side and stop of the discharge which compose said intermittent means, are independently controlled.

An intermittent coating method of the present invention for intermittent coating by utilizing an intermittent coating apparatus comprising a nozzle which applies a paint to a base material intermittent means which repeats feeding and stopping of said paint to said nozzle as well as discharge and stopping of said paint to a return side and a mixer which is disposed in a flow path between said nozzle and said intermittent means, is such method that a pressure loss is produced by said mixer.

DESCRIPTION OF SYMBOLS

Figure 1:
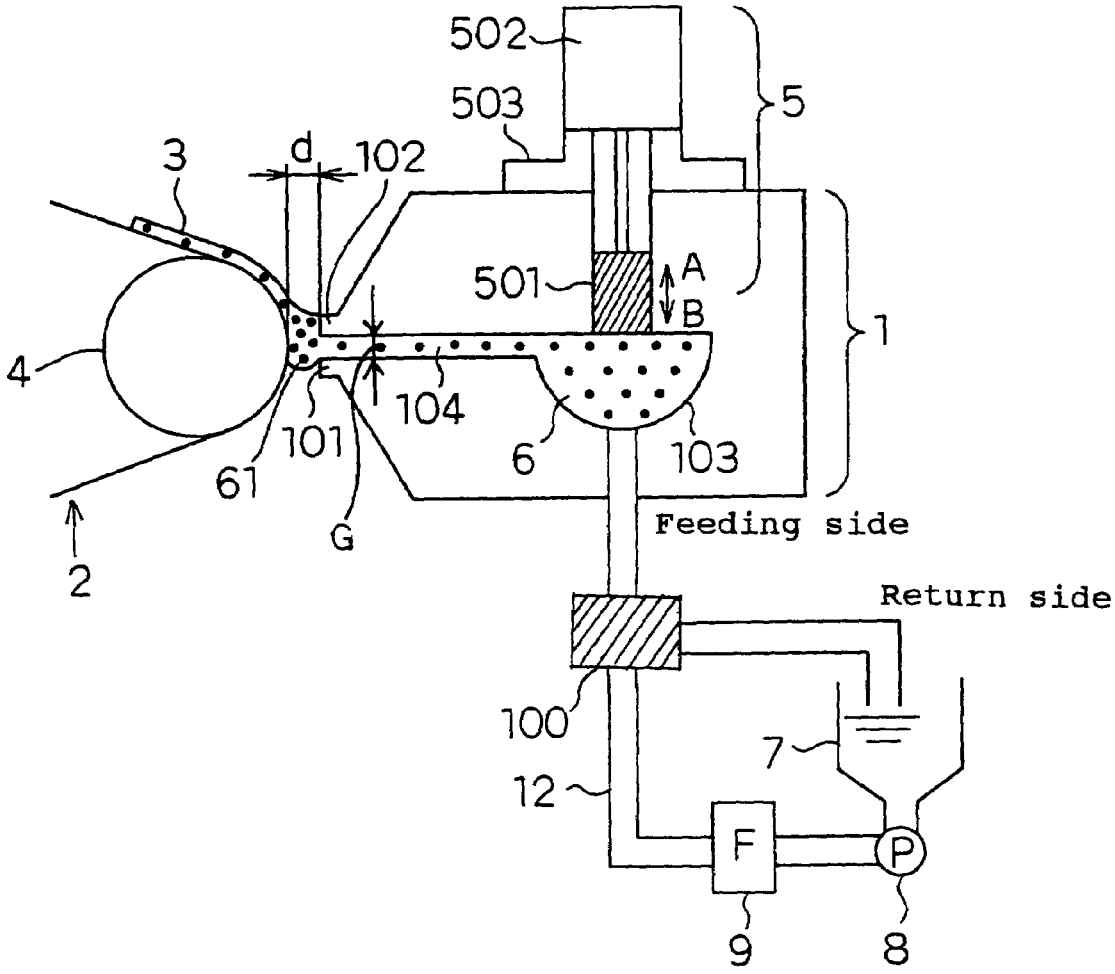
FIG. 1 is a schematic configurational diagram showing a coating method of a first embodiment of the present invention.

1 Nozzle
2 Base material
3 Coated film
4 Roll
5 Driving unit
6 Paint
7 Tank
8 Pump
9 Filter
10 Feeding side two-way valve
11 Return side two-way valve
12 Flow path
13 Mixer
100 Intermittent means

DETAILED DESCRIPTION OF THE PREFERRED EMBODIMENTS

Now, the present invention will be described with reference to the accompanying drawings illustrating the preferred embodiments.

First Embodiment

FIG. 1 shows a schematic diagram illustrating an example of a coating apparatus and a coating method of a first embodiment according to the present invention.

A nozzle 1 is configured by an upstream lip 101, a downstream lip 102, a manifold 103 which is a reservoir of a paint 6 and a slit 104 for extrusion. A width of the slit 104 is represented by G.

A driving unit 5 is configured by an air cylinder 502 which moves a piston 501 in a direction indicated by an arrow A or B and a jig 503 which is used to mount the air cylinder 502 on the nozzle 1. The paint 6 contained in a tank 7 is fed by a pump 8 from the tank 7 by way of a filter 9 and intermittent means 100 into the manifold 103 of the nozzle 1 so that it is extruded from the slit 104.

A base material 2 is supported by a back roll 4 and disposed so as to be apart from a tip of the downstream lip 102 by a distance d of 50 to 500 mm which is adequately set dependently on a viscosity of the paint. The paint 6 extruded from the slit 104 flows into this gap and is coated to form a coated film on the base material 2.

Now, description will be made of operations which are carried out by the intermittent means 100 and the piston 501 to intermittently apply the paint 6 to the base material 2, thereby forming the coated film.

When coating of the paint 6 is not desired, feeding of the paint into the nozzle 1 is stopped by closing a feeding side valve (not shown) of the intermittent means 100 and simultaneously opening a return side valve (not shown) to switch a flow of the paint 6 fed from the pump 8 from a feeding side to a return side. Simultaneously, the paint 6 existing in the slit 104 and a paint reservoir 61 is sucked by moving the piston 501 in the direction indicated by the arrow A.

These operations enable the paint 6 to be intermittently coated with a sharp cut at a terminal end in particular.

At a next coating restart time, an operation in which the feeding side valve of the intermittent means 100 is opened and an operation in which the sucked paint is returned into the nozzle 1 by moving the piston 501 in the direction indicated by the arrow B are simultaneously carried out, and after these operations are started, the feeding of the paint 6 to the nozzle 1 is restarted by closing the return side valve of the intermittent means 100 to switch the flow of the paint 6 fed from the pump 8 to a feeding side.

The paint can be coated stably and intermittently at a predetermined pitch by repeating these operations. The first embodiment uses two-way valves as an example of the intermittent means.

Characteristics of the first embodiment will be described in detail.

Figure 2:
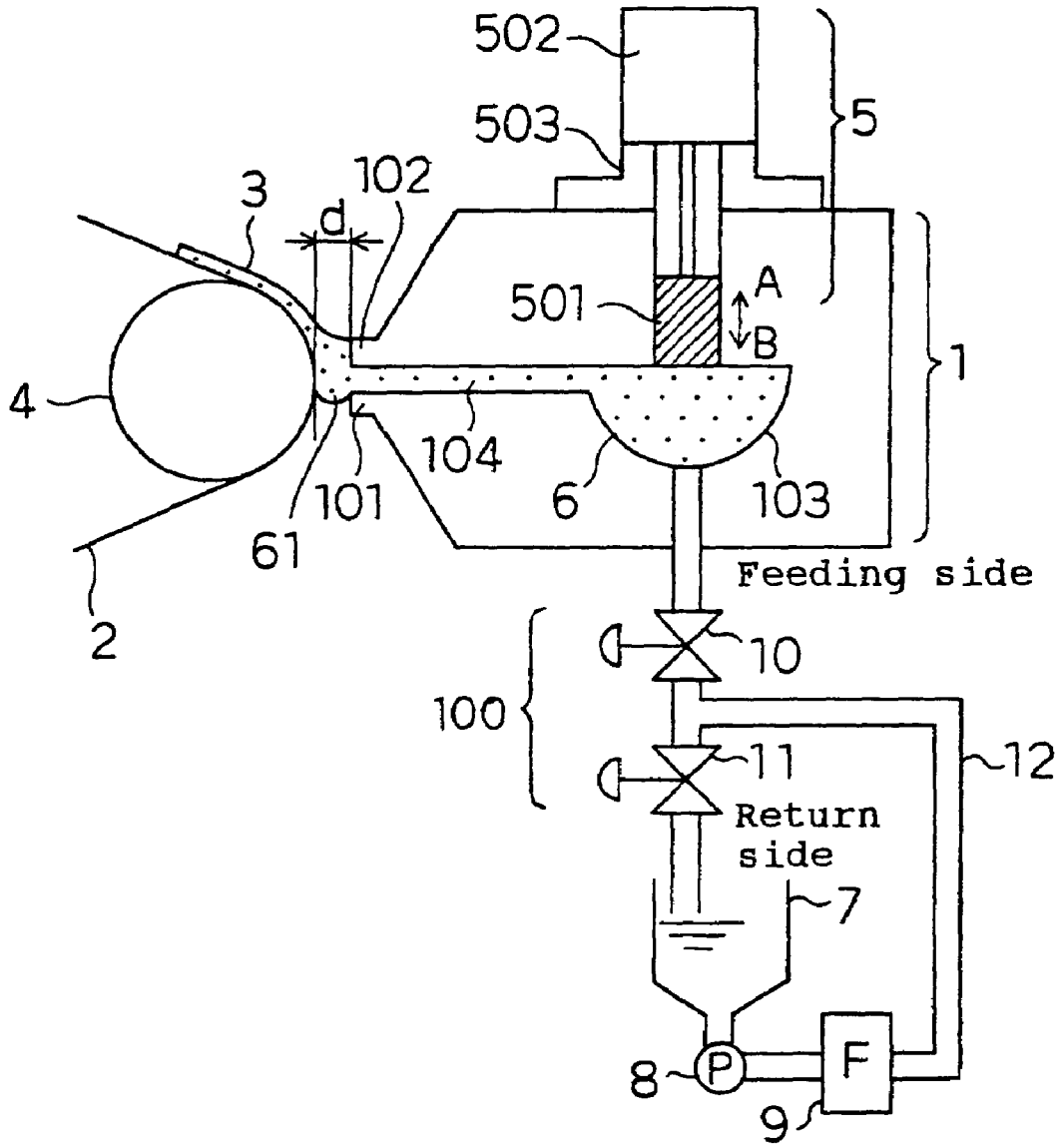
FIG. 2 is a schematic configurational diagram showing the coating method of the first embodiment of the present invention.

A first characteristic lies in that two-way valves are disposed on the feeding side and the return side respectively as an example of the intermittent means 100 as shown in FIG. 2.

At the coating restart time, switching of a feeding side two-way valve 10 is carried out earlier than switching of a return side two-way valve 11 within a range not shorter than 5 msec and not longer than 500 msec. It is more desirable that the switching of the feeding side two-way valve 10 is carried out earlier than the switching of the return side two-way valve 10 within a range not shorter than 5 msec and not longer than 100 msec.

If the switching of the feeding side two-way valve 10 is carried out earlier than that of the return side two-way valve 11 within a range not longer than 5 msec, the return side two-way valve 11 will be closed before the feeding side two-way valve 10 is opened and the paint will flow excessively from a flow path 12, thereby enhancing a paint pressure and thickening a coated film at a coating start end.

If the switching of the feeding side two-way valve 10 is carried out earlier than that of the return side two-way valve 11 within a range not shorter than 500 msec, in contrast, the feeding side two-way valve 10 will be opened too early and the return side two-way valve 11 will not be closed even after coating restart, whereby the paint will not be supplied in a sufficient amount and a coated film will be thin at a coating start end.

Furthermore, it is desirable that at a coating end time the switching of the feeding side two-way valve 10 is carried out earlier than that of the return side two-way valve 11 within a range not shorter than 0 msec and not longer than 100 msec.

If the feeding side two-way valve 10 is switched simultaneously or later than the switiching of the return side two-way valve 11, the return side two-way valve 11 will be opened before the feeding side two-way valve 10 is closed and the paint will be coated before it is fed in a predetermined amount, whereby a coated film will be thin at the coating terminal end.

If the switching of the feeding side two-way valve 10 is carried out earlier than that of the return side two-way valve 11 within a range not shorter than 100 msec, in contrast, the feeding side two-way valve 10 will be closed too early and the return side two-way valve 11 will not be opened even after an end of coating, whereby a paint pressure will be enhanced till the end of coating and a coated film will be thick at the coating terminal end.

Figure 8:
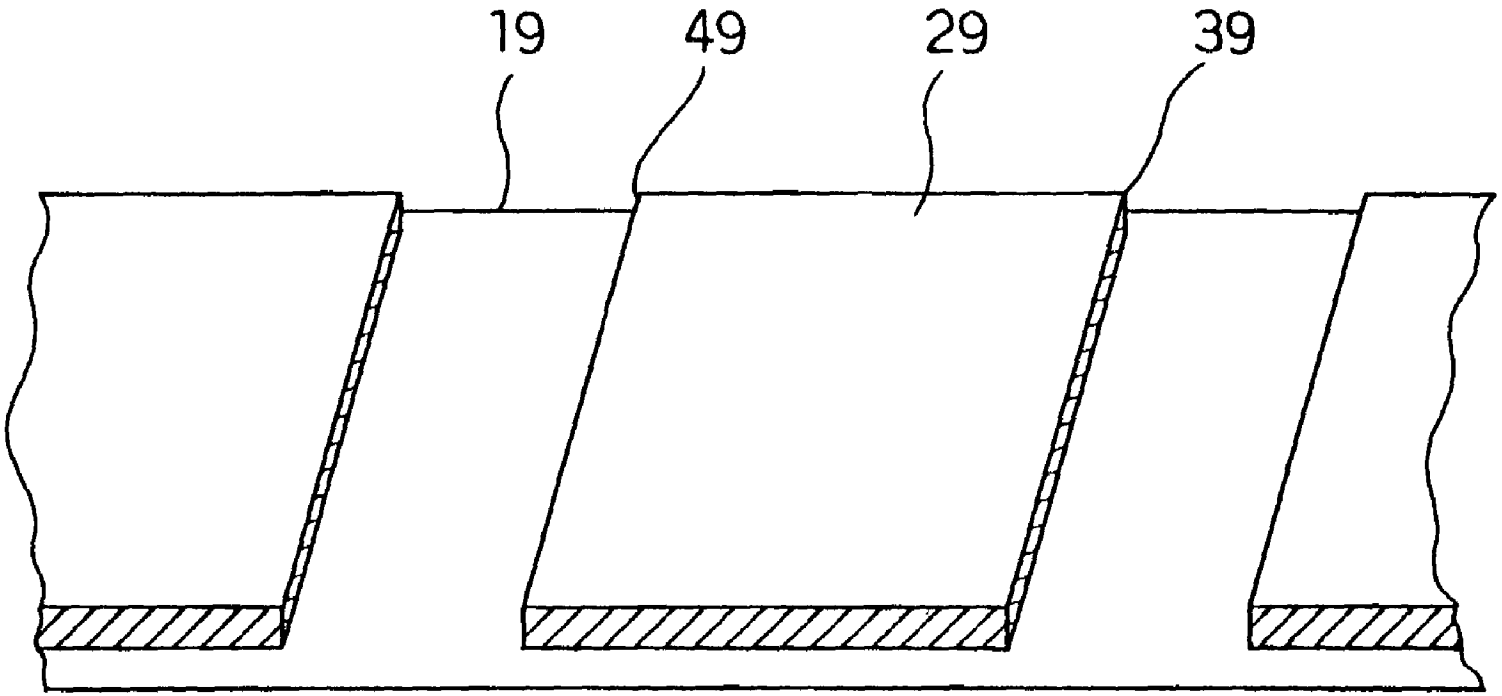
FIG. 8 is a perspective view showing a battery electrode plate in the first through fifth embodiments of the present invention.

Owing to the operations of the two-way valves described above, the first embodiment is capable of forming a coated film which is free from swelling at the coating start end and has thickness uniform from the coating start end to the terminal end as shown in FIG. 8.

In addition, it is possible to form a coated film in such a condition as shown in FIG. 8 by composing the intermittent means 100 with a three-way valve 100, in place of the two way valve, which repeats feeding of the paint 6 fed from the pump 8 into the flow path 12 and the nozzle 1 and stop of the feeding as well as discharge of the paint 6 into a return and stop of the discharge as shown in FIG. 1, and by operating the piston 501 to switch the flow of the paint 6 from the return side to the feeding side at the coating start time, later than the operation of the piston 501 to switch the flow of the paint 6 from the feeding side to the return side at a coating intermittent time within a range not shorter than 50 msec and not longer than 500 msec.

A second characteristic lies in that the first embodiment is capable of preventing coating stripes from being formed since the piston 501 of a driving unit 5 breaks agglomerated lumps by exerting a shearing force to these lumps during the repeated operations.

Furthermore, it is important to suck the paint from the slit 104 and the paint reservoir 61 in an extremely small amount not smaller than 0.01 cc and not larger than 10 cc by moving the piston 501 of the driving unit 5 in the direction indicated by the arrow A.

If the paint 6 is sucked in an amount smaller than 0.01 cc, the small amount will allow the paint to remain between the nozzle 1 and the base material 2, thereby making it impossible to obtain linear coating start end and terminal end.

If the paint 6 is sucked in an amount larger than 10 cc, in contrast, the large sucking amount will allow air to be sucked together with the paint into the slit 105 and extruded together at a stage to extrude the sucked paint at the coating restart time, whereby the coating start end will be disturbed and thickness will be varied 10% or more due to a pressure variation in the manifold 103.

Since the first embodiment produces no pressure variation in the manifold 103, the embodiment discharges the paint 6 from the nozzle 1 at a flow rate free from a variation, thereby being capable of forming a coated film having thickness which is uniform from a start end to a terminal end and varies within 1% in a direction of width.

Now, description will be made of a concrete example of the first embodiment wherein the present invention is applied to lithium ion secondary batteries.

Used for the example was the nozzle 1 shown in FIG. 1 which had distance d=200 mm, slit gap G=0.5 mm and coating width=480 mm. An opening operation timing of the feeding side two-way valve 10 at the coating start time was varied within a range of −150 to 510 msec from a closing operation timing of the return side two-way valve 11 and an amount of the paint 6 sucked into the nozzle 1 was varied within a range from 0.005 to 11 cc.

Used as a negative electrode was a copper foil which had a collector material 10 mm thick and 500 mm wide, and adopted as a negative electrode paste was a kneaded mixture of a carbon material, CMC (carboxymethylcellulose) and water.

By coating this negative electrode paste to the collector material at predetermined pitche of 300 to 400 mm with the coating apparatus described as the first embodiment, intermittent active substance layers were formed and dried.

Used as a positive electrode was an aluminium foil which had a collector material 20 mm thick and 500 mm wide, and adopted as a positive electrode paste was a kneaded mixture of $LiCoO_2$, electrically conductive carbon black, a fluoroplastic, CMC and water.

By coating this positive electrode paste to the collector material at the predetermined pitches with the coating apparatus described as the first embodiment, intermittent active substance layers were formed and dried. After the obtained positive electrode plate and negative electrode plate are rolled to a predetermined thickness, lithium ion secondary batteries were manufactured by slitting the positive electrode plate and the negative electrode plate at a predetermine width.

As a comparative example, similar intermittent coating was carried out with the conventional intermittent coating apparatus. After the obtained positive electrode plate and negative electrode plate are rolled to a predetermined thickness, lithium ion secondary batteries were manufactured as the comparative example by slitting the positive electrode plate and the negative electrode plate at the predetermined width.

Electrode plates which were subjected to coating and drying described above as well as the batteries were evaluated for items mentioned below to confirm effects of the first embodiment.

(1) Thickness (Swelling) at Coating Start End

For the active substance layer thickness of a section 20 mm long from the coating start end was measured with a micrometer at 20 locations at a pitch of 1 mm, and a difference between maximum thickness and minimum thickness of the coating start end was evaluated as swelling of the coating start end.

The evaluation results are summarized in Table 1. The table clarifies that the starting end is free from the swelling and favorable battery electrode plates are obtained within the range specified for the first embodiment.

| Opening time of feeding side two-way valve relative to return side two-way valve (msec) | Amount of paint sucked into nozzle (cc) | Swelling at start end (μm) | Rolled condition | Evaluation | Remarks |
|---|---|---|---|---|---|
| −50 | 0.2 | 100 | X | X | Outside range for first embodiment |
| −5 | 0.2 | 85 | X | X | |
| 0 | 0.2 | 60 | X | X | |
| 5 | 0.2 | 15 | ○ | ○ | Within range for first embodiment |
| 50 | 0.2 | 5 | ○ | ○ | |
| 500 | 0.2 | 9 | ○ | ○ | |
| 510 | 0.2 | −22 | Δ | X | Outside range for first embodiment |
| 50 | 0.005 | 45 | X | X | |
| 50 | 0.01 | 18 | ○ | ○ | Within range for first embodiment |
| 50 | 10 | 19 | ○ | ○ | |
| 50 | 11 | 52 | X | X | Outside range for first embodiment |
| — | — | 60 | X | X | |

○ Can be rolled
Δ Partially peeled
X Peeled
○ Favorable
X Not usable as battery
Comparative example (conventional intermittent Coating apparatus)

(2) Rolled Condition

At a step to roll the electrode plates, dropped conditions of the active substance layers caused due to peeled start ends were compared by visual check. The check results indicate that obviously the active substance layers did not drop on account of the swelling of the start ends and favorable battery electrode plates are obtained within the range specified for the first embodiment.

(3) Cycle Characteristic

Discharge capacities were measured while charge and discharge were repeated at normal temperature in definite conditions (current 1600 mA and end voltage 3V for discharge, current 160 mA and end voltage 4.2 V for charge), and the comparison concerning a cycle characteristic was performed by the number of charges and discharges (cycles) when the discharge capacities are 90% of initial discharge capacities.

Figure 9:
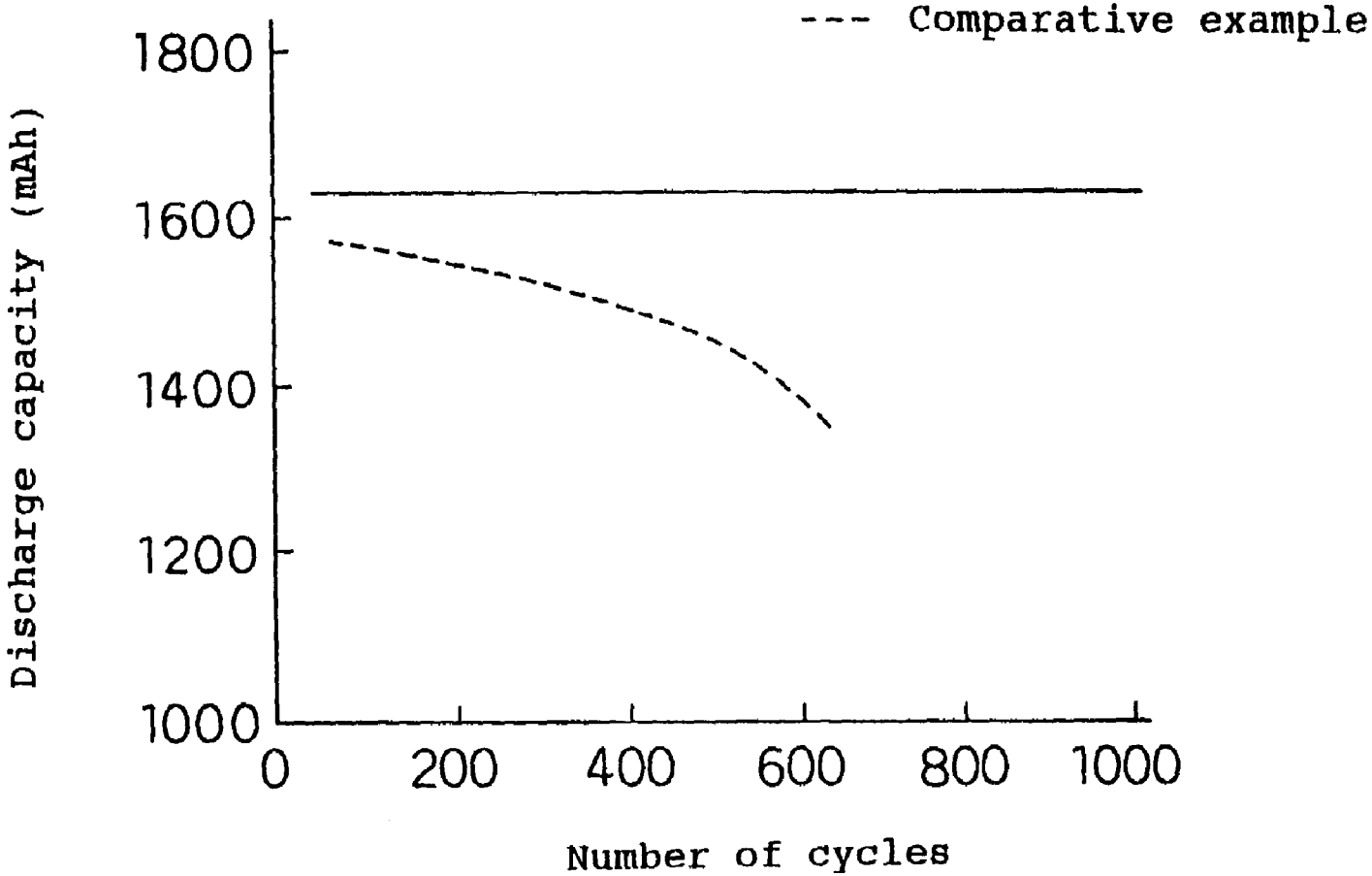
FIG. 9 is a graph showing measured results of cycle characteristics in the first through fifth embodiments of the present invention.

The results are summarized in FIG. 9. The battery of the first embodiment has a cycle characteristic which is clearly upgraded as compared with that of the conventional example.

As a result of the above described evaluation, the effects of the first embodiment will be summarized and explained below:

First, the first embodiment is capable of preventing the coating start end from swelling by opening the feeding side two-way valve 10 earlier than the closing operation of the return side two-way valve 11 at the intermittently coating and forming the active substance layers on the collector material, at the coating start time in particular. Accordingly, the first embodiment is capable of coating and forming the active substance layer so that the active substance has an extremely uniform thickness from the coating start end to the terminal end, and preventing the active substance layer from being peeled and dropped at a production step, a rolling step in particular, of lithium ion secondary batteries and the like, thereby remarkably enhancing yields of products.

Secondly, the first embodiment which repeatedly operates the piston 501 of the driving unit 5 is capable of exerting a strong shearing force to the paste in the nozzle 1, breaking agglomerated lumps of active substance powder in the paste and enhancing fluidity, thereby providing the active substance layer which contains the active substance powder uniformly dispersed and is free from coating stripes.

As a result, the first embodiment is capable of manufacturing a battery having the upgraded cycle characteristic and enhancing yields of the products.

Second Embodiment

Figure 3:
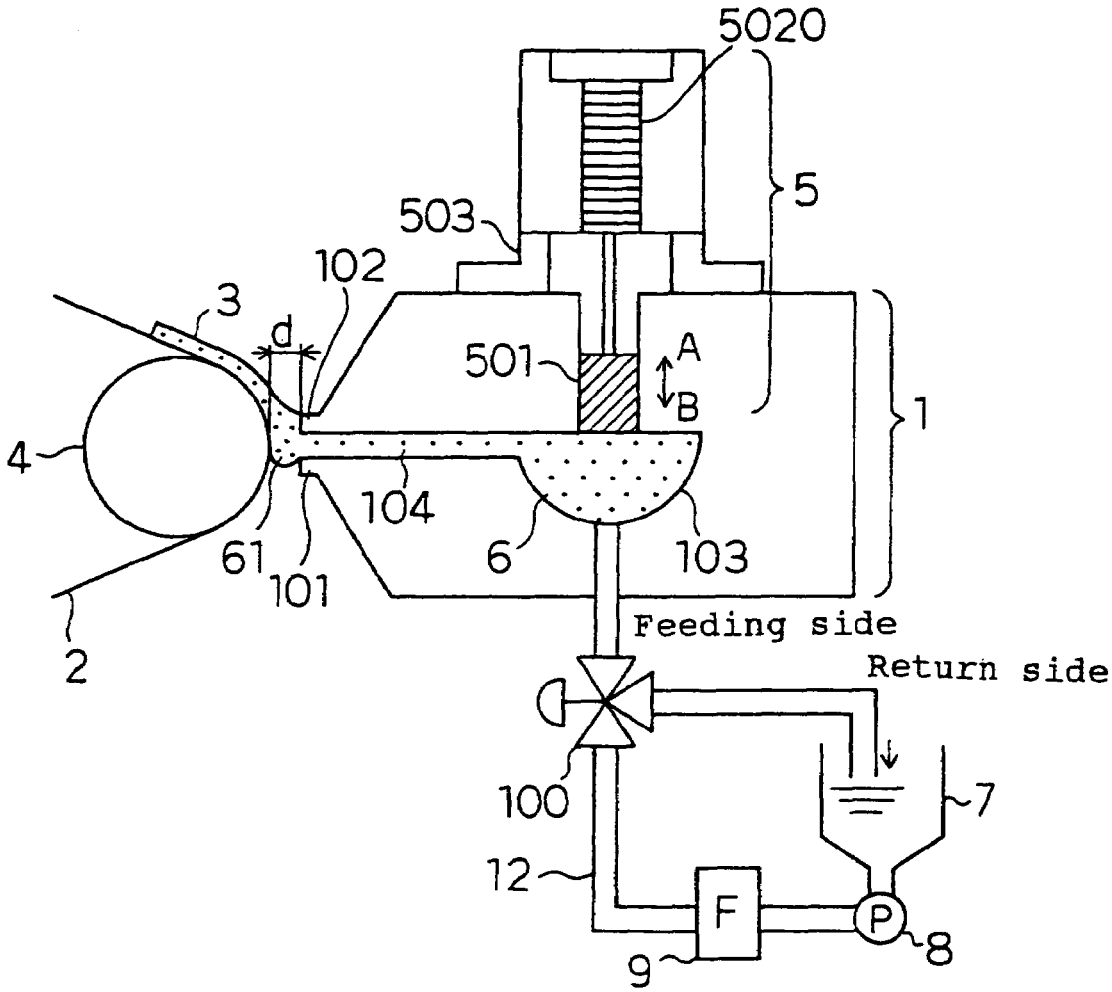
FIG. 3 is a schematic configurational diagram showing a coating method of a second embodiment of the present invention.

FIG. 3 shows a schematic diagram of a coating apparatus and a coating method of a second embodiment of the present invention.

The second embodiment is characterized in that an operation time A msec of a piston 501 to suck a paint 6 into a sucking device (not shown) in a nozzle 1 and an operation time B msec of the piston 501 to return the paint 6 from the sucking device into the nozzle 1 are set in a relation of A<B in a driving unit 5.

Furthermore, the second embodiment is characterized also in that the piston 501 is driven with a piezoelectric element 502. Furthermore, the second embodiment uses a three-way valve as intermittent means 100.

Members other than the driving unit 5 of the second embodiment may be those of the first embodiment, which are not described in particular.

When the paint 6 is not to be coated, feeding of the paint 6 to the nozzle 1 is stopped by switching a flow of the paint 6 fed from the pump 8 by the intermittent means 100 to a return side, and simultaneously the paint 6 existing in the slit 104 and the reservoir 61 is sucked by moving the piston 501 with the piezoelectric element 502 in the direction indicated by the arrow A.

At a next coating restart time, the feeding of the paint 6 to the nozzle 1 is restarted by switching the flow of the paint 6 fed from the pump 8 to the feeding side by the intermittent means 100 to a feeding side and the piston 501 is moved with the piezoelectric element 502 in the direction indicated by the arrow B in a time which is longer than the operation time to suck the paint. Accordingly, the paint 6 having a volume which has been sucked after start of coating till end of coating, is gradually returned into the nozzle 1.

When a time to operate the piston 501 with the piezoelectric element 502 to suck the paint 6 into the sucking device in the nozzle is represented by A msec and a time to return the paint 6 from the sucking device into the nozzle is designated by B msec, if A>B, the paint 6 which has been sucked is returned at a stroke at a some time after the start of coating till the end of coating, whereby produced thickness of a coated film 3 will be remarkably varied in a longitudinal direction. Such relation of A<B is therefore desirable.

Furthermore, it is important to return the paint 6 from the sucking device into the nozzle 1 at a flow rate not lower than 1 cc/msec. If the paint 6 is returned from the sucking device into the nozzle 1 at a flow rate not higher than 1 cc/msec, the thickness of the coated film 3 will be remarkably varied in the longitudinal direction.

The second embodiment which selects a flow rate not lower than 1 cc/msec and does not return the sucked paint 6 at any time after the start of coating till the end of coating, is capable of forming a coated film which has no swelling at a coating start end and thickness uniform from a coating start end to a terminal end as shown in FIG. 8.

The second embodiment exhibited effects which were similar to those of the first embodiment.

Third Embodiment

Figure 4:
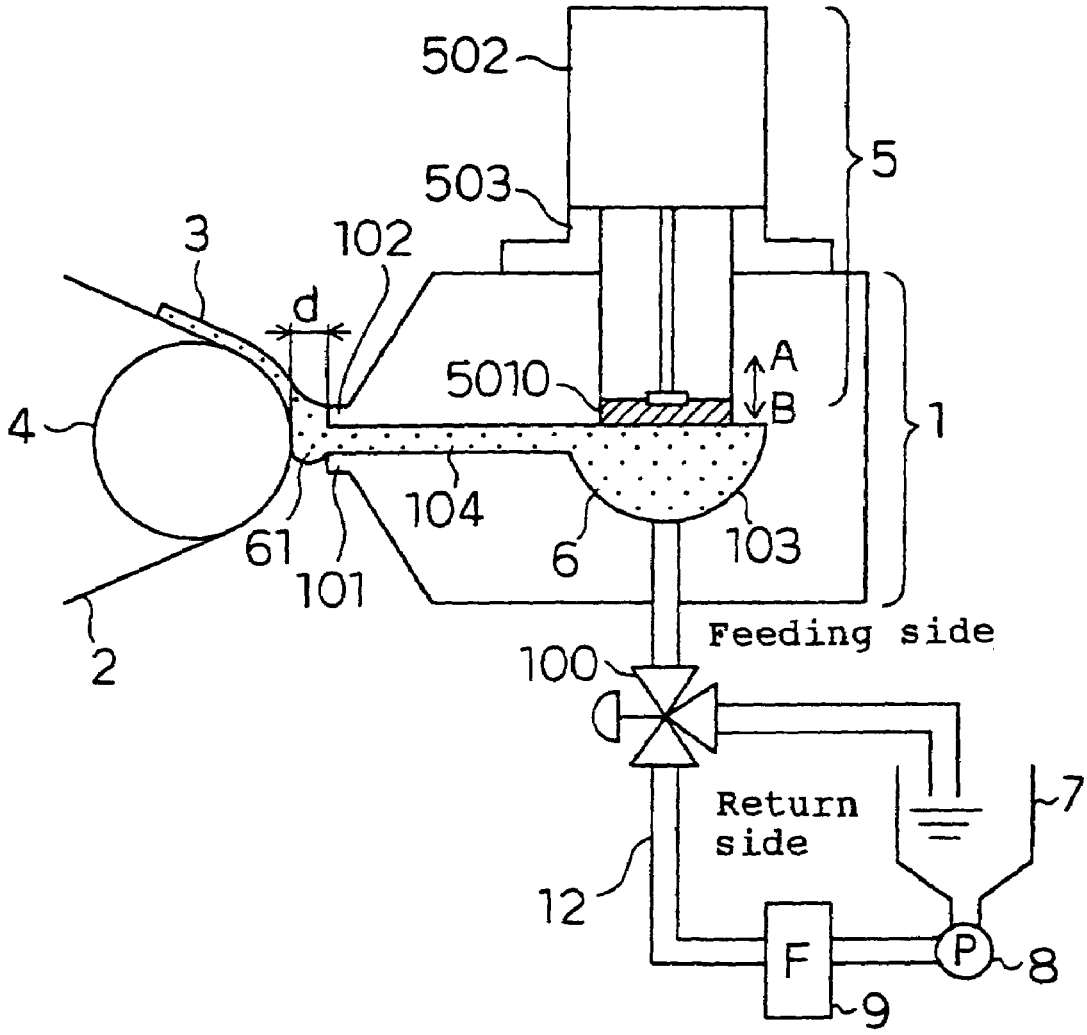
FIG. 4 is a schematic configurational diagram showing a coating apparatus of a third embodiment of the present invention.

FIG. 4 is a schematic diagram of an apparatus to carry out a coating apparatus of a third embodiment according to the present invention.

The third embodiment is characterized in that it comprises a bellowphragm 501 which is moved by moving a pin of a driving unit 5 to suck and discharge a paint 6 into and out of a nozzle 1 and a paint reservoir 61. Other members of the third embodiment may be those of the first embodiment, which are not described in particular.

In the third embodiment, a circumferential end of the bellowphragm 501 is fixed to an inside of a nozzle 1 and a central portion of the bellowphragm 501 is moved with the pin in a direction indicated by an arrow A or B.

Accordingly, a sucking speed and a returning speed of the bellowphragm 501 can be kept always constant under no influence due to friction with a wall surface in the nozzle 1, whereby the third embodiment is capable of remarkably enhancing an intermittent pitch of coated film layers which are to be coated and formed at a predetermined pitch.

In addition to this effect, the third embodiment can exhibit effects which are similar to those of the first embodiment.

Fourth Embodiment

Figure 5:
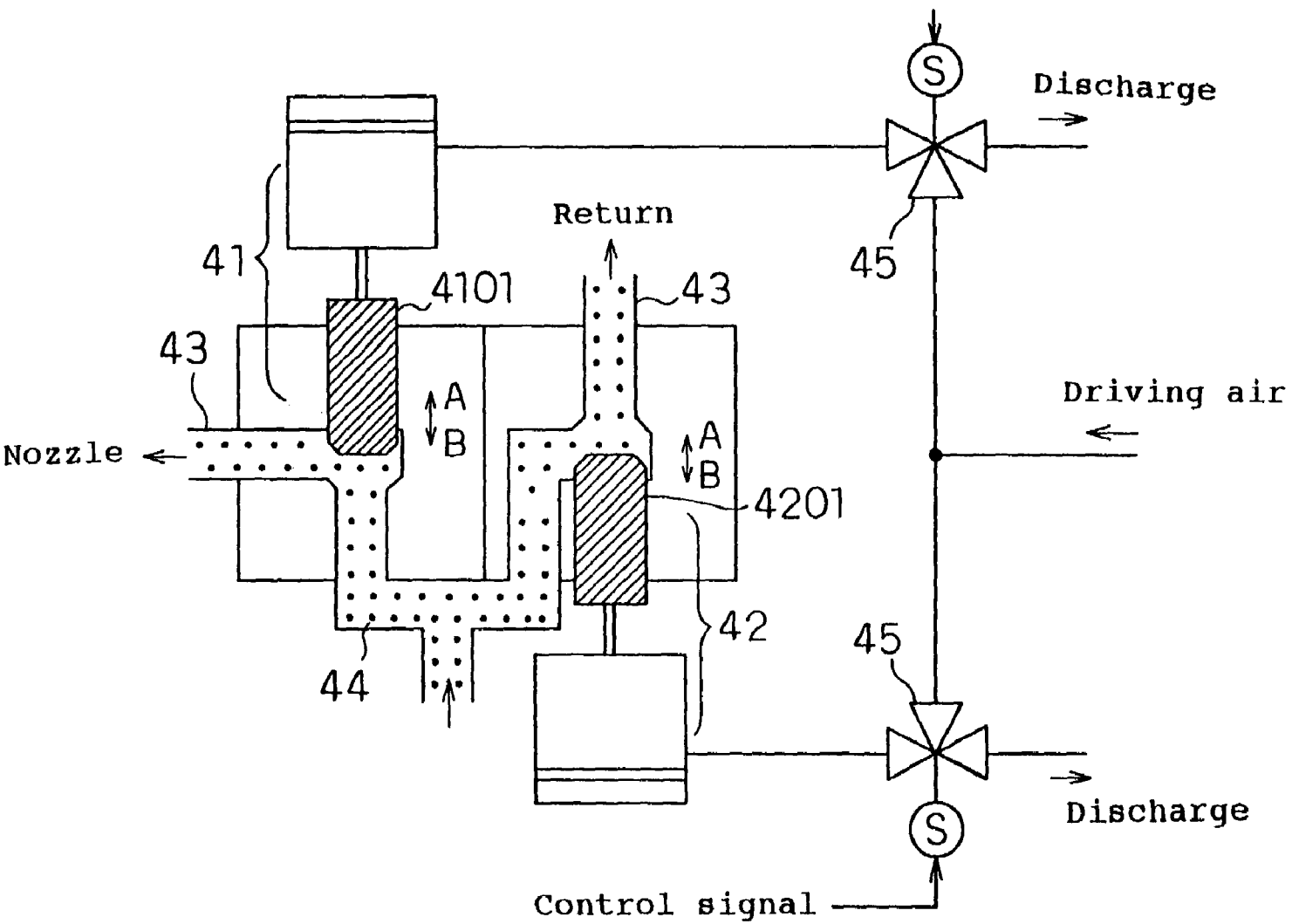
FIG. 5 is a schematic configurational diagram showing a coating apparatus of a fourth embodiment of the present invention.

FIG. 5 is a schematic diagram of a coating apparatus which carries out a coating method of a fourth embodiment of the present invention.

The fourth embodiment relates to a two-way valve body and uses other members which are similar to those of the first embodiments and not described in particular.

The fourth embodiment comprises means which sucks and discharges a paint 44 into and out of a nozzle 1 as a piston (not shown) disposed in the nozzle 1 moves, a feeding side two-way valve 41 which repeats feeding of the paint 44 into the nozzle (not shown) and stop of the feeding, a return side two-way valve 42 which repeats discharge of the paint 44 to a return and stop of the discharge, and a flow path 43 which communicates the feeding side two-way valve 41, the return side two-way valve 42 and so on.

Furthermore, the fourth embodiment is characterized in that it is configured to close or open the flow path 43 by moving pistons 4101 and 4201, and that operations of the feeding side two-way valve 41 and the return side two-way valve 42 are controlled independently with solenoid valves 45.

Furthermore, the piston 4201 is moved to close the flow path in a direction which is the same as that of a flow of the paint 44 toward a return side.

At a coating stop time, feeding of the paint 44 flowing through the flow path 43 in the direction of the nozzle 1 is stopped by supplying driving air from the solenoid valve 45 to the feeding side two-way valve 41 with a preset control signal (not shown) and moving the piston 4101 of the feeding side two-way valve 41 in a direction indicated by an arrow B, and simultaneously the paint 44 flowing through the flow path 43 is discharged toward the return by exhausting the driving air for the return side two-way valve 42 from the solenoid valve 45 and moving the piston 4201 in a direction indicated by the arrow B.

At a next coating start time, the paint 44 flowing through the flow path 43 is fed toward the nozzle 1 by supplying the driving air from the solenoid valve 45 to the feeding side two-way valve 41 and moving the piston 4101 of the feeding side two-way valve 41 in the direction indicated by an arrow A, and simultaneously the discharge of the paint 44 flowing through the flow path 43 is stopped by exhausting the driving air for the return side two-way valve 42 from the solenoid valve 45 and moving the piston 4201 of the return side two-way valve 42 in the direction indicated by the arrow A.

The fourth embodiment moves the piston 4201 of the return side two-way valve 42, at the coating start time, in a direction which is the same as that of a flow of the paint 44 toward the return, thereby preventing the paint 44 from flowing into the nozzle 1 in a volume corresponding to the displacement of the piston 4201.

Furthermore, it is extremely important to carry out switching of the feeding side two-way valve 41 earlier than that of the return side two-way valve 42 within a range not shorter than 5 msec and not longer than 500 msec.

It is more preferable to select a range which is not shorter than 5 msec and not longer than 100 msec.

If the switching of feeding side two-way valve 41 is carried out earlier than that of the return side two-way valve 42 within a range not longer than 5 msec, the return side two-way valve 42 is closed before the feeding side two-way valve 41 is opened, the paint 6 will flow excessively from the flow path 43 and a paint pressure is enhanced, thereby thickening a coated film at a coating start end.

If the switching of the feeding side two-way valve 41 is switched carried out earlier than the return side two-way valve 42 within a range not shorter than 500 msec, in contrast, the feeding side two-way valve 41 will be opened too early, the return side two-way valve 42 will not be closed even after coating restart and the paint 6 will be coated before it is fed in a predetermined amount, whereby a coated film will be thin at the coating start end.

Furthermore, it is important at a coating end time to carry out switching of the feeding side two-way valve 41 earlier than that of the return side two-way valve 42 within a range not shorter than 0 msec and not longer than 100 msec.

This is because when the return side two-way valve 42 will be opened before the feeding side two-way valve 41 is closed, the paint will be coated before it is fed in a sufficient amount and a coated film will be thin at a coating terminal end when the switching of the feeding side two-way valve 41 is earlier than that of the return side two-way valve 42 within a range shorter than 0 msec.

If the switching of the feeding side two-way valve 41 is earlier than that of the return side two-way valve 42 within a range not shorter than 100 msec, in contrast, the feeding side two-way valve 41 will be closed too early and the return side two-way valve 42 will not be opened even after termination of the coating, whereby a pressure of the paint will go on rising immediately till the termination of the coating and a coated film will be thickened at the coating terminal end.

The fourth embodiment is capable of forming a coated film which is free from swelling at the coating start end and has thickness extremely uniform from the coating start end to the terminal end.

The fourth embodiment exhibited effects which were similar to those of the first embodiment.

Fifth Embodiment

Now, description will be made of a configuration of a coating apparatus of a fifth embodiment of the present invention.

Figure 6:
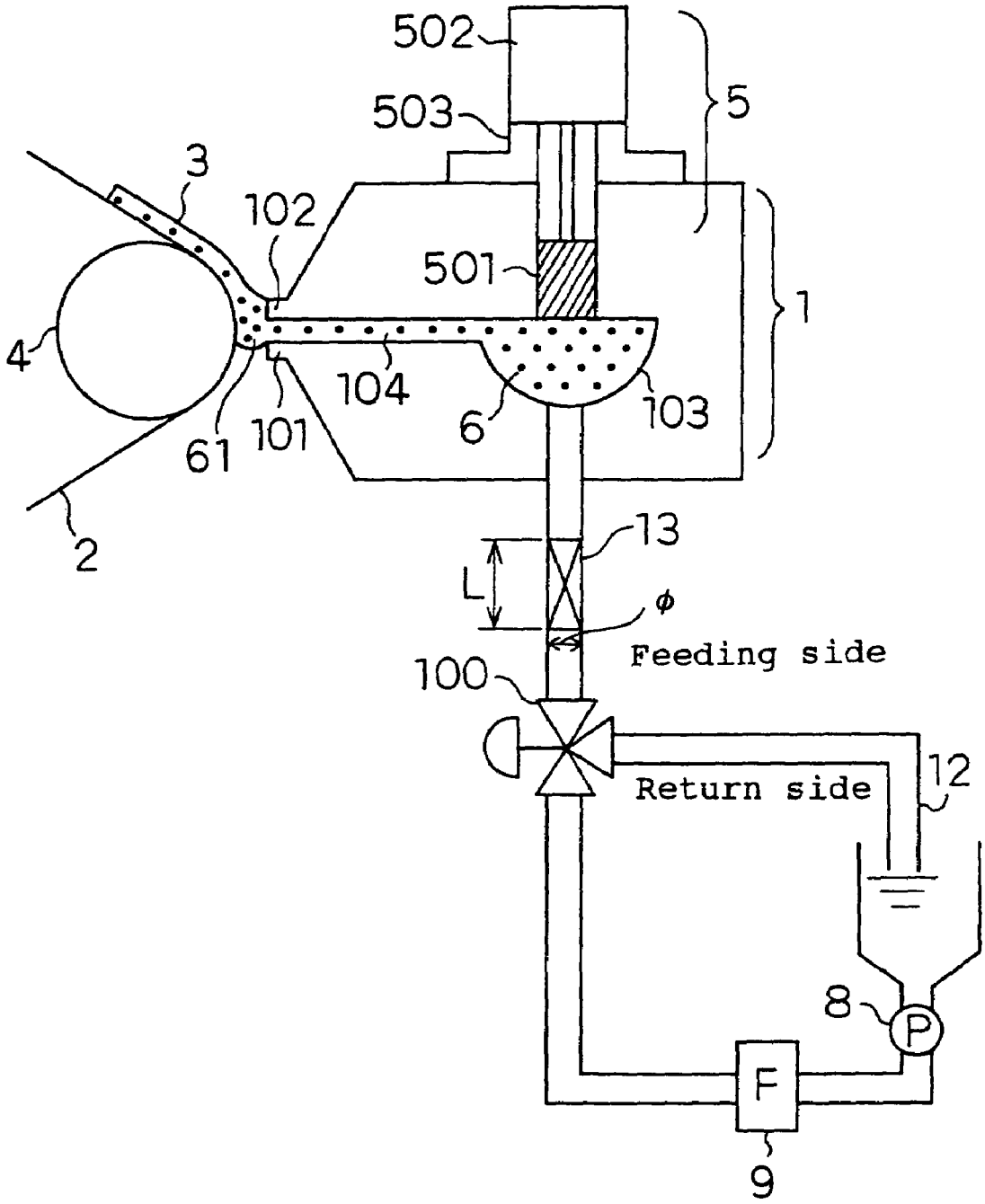
FIG. 6 is a schematic configurational diagram showing a coating apparatus of a fifth embodiment of the present invention.
Figure 7:
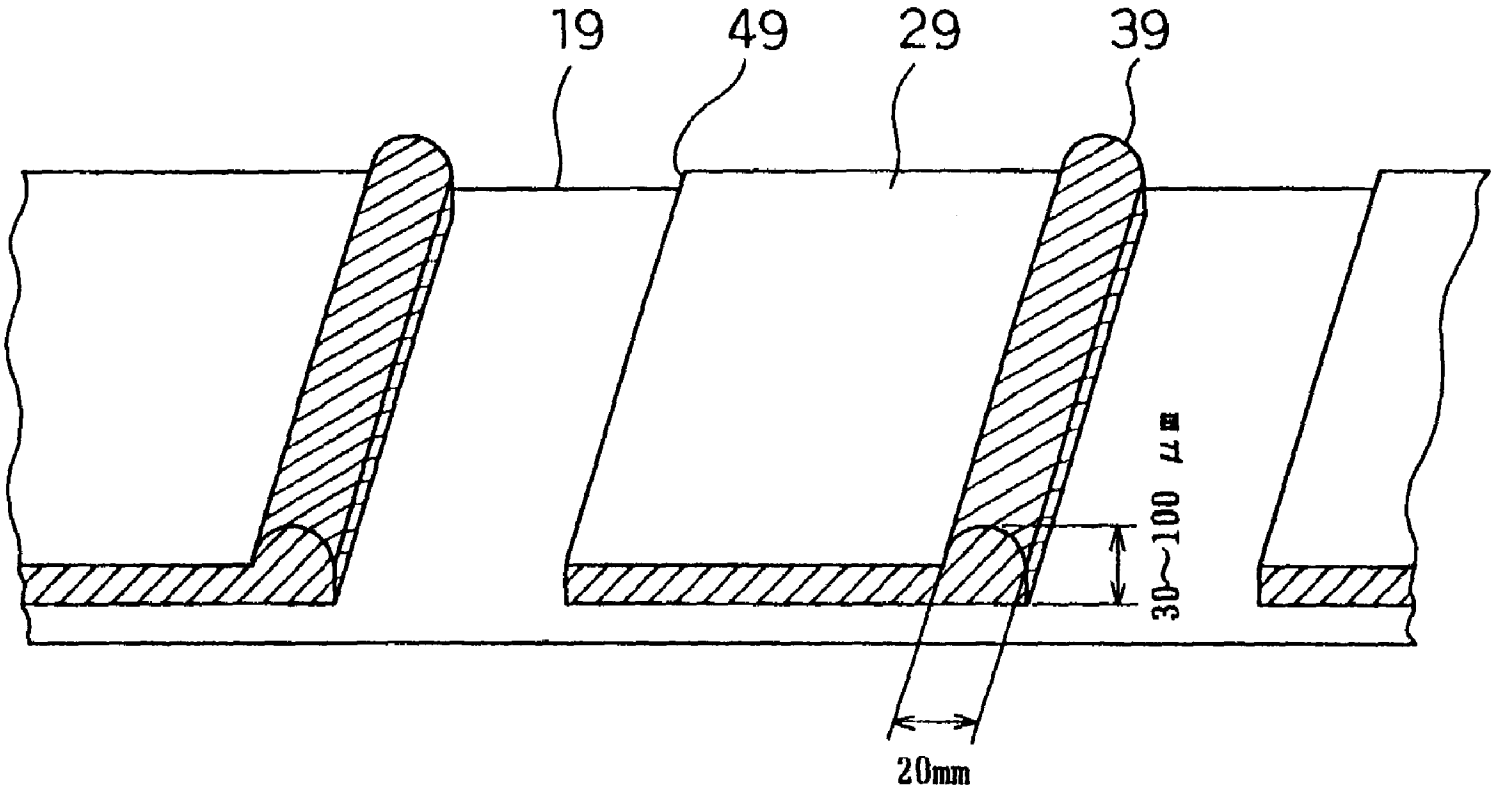
Fig. 7 PRIOR ART
FIG. 7 is a perspective view showing a battery electrode plate formed by conventional intermittent coating means.

FIG. 6 shows a schematic configurational diagram of the coating apparatus of the fifth embodiment of the present invention. A characteristic of the fifth embodiment lies in that a paint 6 is coated intermittently to form layers by producing a pressure loss in the paint 6 fed from a feeding side of intermittent means 100 to a nozzle 1 with a mixer 13 which is disposed in a flow path 12 between the nozzle 1 for coating the paint 6 and the intermittent means 100 as shown in FIG. 6.

Members other than the mixer 13 of the fifth embodiment may be the same as those of the first embodiment and not described in particular.

It is important for the fifth embodiment that the mixer 13 disposed in the flow path 12 has a length L which is not shorter than 1 mm and not longer than 200 mm. If the length L is shorter than 1 mm, a small pressure loss of the paint 6 will be produced by the mixer 13 and the paint 6 can flow easily into the nozzle 1, whereby the paint 6 will be coated under an influence due to an abrupt pressure rise which is caused by a change of a flow direction and a coated film will be thick at the coating start end.

If the length L is longer than 200 mm, in contrast, a large pressure loss will be produced by the mixer 13 and the paint 6 cannot flow easily into the nozzle 1, whereby the paint 6 will be coated before it is fed in a sufficient amount and a film will be thin at the coating start end.

Furthermore, it is important that the mixer 13 disposed in the flow path 12 has a diameter which is not smaller than 5 mm and not larger than 100 mm. If the diameter is smaller than 5 mm, a large pressure loss will be produced in the paint 6 by the mixer 13 and the paint 6 cannot flow easily into the nozzle 1, whereby the paint 6 will be coated before it is fed in the sufficient amount and a coated film will be thin at the coating start end.

If the diameter is larger than 100 mm, in contrast, a small pressure loss will be produced by the mixer 13 and the paint 6 can flow easily into the nozzle 1, whereby the paint 6 will be coated under the influence due to the abrupt pressure rise which is caused by the change of the flow direction and a coated film will be thick at the coating start end.

The fifth embodiment prevents the abrupt pressure rise which is caused when the flow direction is changed from the return side to the feeding side by the intermittent means 100 and is capable of forming a coated film having thickness extremely uniform from the coating start end to the terminal end as shown in FIG. 8 where there is no swelling of the coating start end.

The fifth embodiment exhibited effects which are similar to those of the first embodiment.

The present invention makes it possible to uniformalize thickness in a longitudinal direction of layers intermittently formed on a base material and preventing a thick layer from being formed at a coating start end, thereby exhibiting remarkable effects not only to improve performance of batteries and capacitors but also to enhance yields of products.

What is claimed is:

1. An intermittent coating method for intermittent coating by utilizing an intermittent coating apparatus comprising a nozzle which applies a paint to a base material and intermittent means which repeats feeding and stopping of said paint to said nozzle as well as discharge and stopping of said paint to a return side, said method comprising:

applying paint intermittently to a base material, wherein said intermittent means:

(i) starts discharging said paint to said return side before starting discharging of said paint to said nozzle, (ii) starts discharging said paint to said nozzle, (iii) stops discharging said paint to said return side after a predetermined period of time while continuing said paint discharging to said nozzle to thereby start applying said paint to said base material, (iv) stops discharging said paint to said nozzle, and (v) starts discharging said paint to said return side after said stopping of said paint discharging to said nozzle.

2. The An intermittent coating method according to claim 1, wherein said intermittent means includes a feeding side two-way valve for repeatedly feeding and stopping said feeding to said nozzle and a return side two-way valve for repeatedly discharging and stopping discharge of paint to said return side, and wherein, during said steps (i) through (v), said intermittent means independently controls said feeding side two-way valve and said return side two-way valve.

* * * * *